United States Patent [19]

Terral

[11] 4,239,082

[45] Dec. 16, 1980

[54] MULTIPLE FLOW VALVES AND SIDEPOCKET MANDREL

[75] Inventor: Ben D. Terral, Houston, Tex.

[73] Assignee: Camco, Incorporated, Houston, Tex.

[21] Appl. No.: 23,061

[22] Filed: Mar. 23, 1979

[51] Int. Cl.[2] ..... E21B 23/02

[52] U.S. Cl. ..... 166/117.5; 137/155

[58] Field of Search ..... 166/117.5; 137/155; 417/109, 111

[56] References Cited

U.S. PATENT DOCUMENTS

| | | | |
|---|---|---|---|
| 2,342,301 | 2/1944 | Peters | 137/155 |
| 2,385,316 | 9/1945 | Walton | 137/155 |
| 2,465,060 | 3/1949 | Carlisle et al. | 137/155 |
| 2,620,740 | 12/1952 | Garrett et al. | 137/155 |
| 2,806,429 | 9/1957 | Anderson et al. | 137/155 |
| 2,824,525 | 2/1958 | McGowen, Jr. | 166/117.5 |
| 2,963,036 | 12/1960 | Surles | 137/155 |
| 3,741,299 | 6/1973 | Terral | 166/117.5 |
| 3,874,445 | 4/1975 | Terral | 166/117.5 |
| 3,889,748 | 6/1975 | Tausch | 166/117.5 |

*Primary Examiner*—James A. Leppink
*Attorney, Agent, or Firm*—Fulbright & Jaworski

[57] ABSTRACT

The combination of a mandrel and multiple flow control valves for use in a well tubing in which the mandrel includes a sidepocket and a locking shoulder aligned with the pocket. A plurality of vertically connected flow control valves, such as gas lift valves, each having an inlet and an outlet are adapted to be positioned in the pocket by a single latch connected to the valves for engaging the locking shoulder. The pocket has a vertical length sufficient for receiving the valves, a plurality of vertically spaced openings extending between the interior of the pocket and the outside of the mandrel, one of the openings being positioned adjacent each of the inlets of the valves when the valves are installed, and a plurality of passageways extending between the interior of the pocket and the interior of the mandrel with one of the passageways being positioned to communicate with each of the outlets of said valves when the valves are installed. In one embodiment, each passageway is positioned below one of the openings and the pocket includes a sealing surface on each side of each vertically spaced opening for coacting with a seal on the valves for isolating the valves from each other. In another embodiment the number of openings is two and includes a sealing surface in the pocket above and below the two openings, and the number of passageways is two and one is positioned above the upper sealing surface and the other is positioned below the lower sealing surface. The valves may be gas lift valves having a pressure charged bellows acting against a valve element in a direction to close the valve, and the bellows of both of said valves may be charged from a single pressure chamber.

1 Claim, 13 Drawing Figures

20
18
22
10
26
24
14
16
60
52
62
56
64
54
66
58
2
2

14
54
16
24
54

42
12
44
32
30
46
34
48
38
36
50
40

12
13
33
31
44

20a
22a
10a
14a
26a
56a
60a
52a
24a
54a
66a
58a
42a
12a
34a
44a
30a
32a
38a
36a
50a
40a 42a
34a
44a 33b
41b 39b
43b
38b
36b
45b
50b
40b

MULTIPLE FLOW VALVES AND SIDEPOCKET MANDREL

BACKGROUND OF THE INVENTION

The use of sidepocket mandrels and fluid control valves, such as gas lift valves, is old. However, in many cases there is a need for increasing the volume of gas admitted by the valves which is needed for lifting purposes. The exterior dimensions of mandrels are limited, and therefore the size of the valves, which may be installed therein, is similarly limited. One way of increasing gas flow is the use of a multiple valve pocket mandrel and valves such as shown in U.S. Pat. No. 3,874,445, but such installation requires multiple down hole trips for installing or removing the individual valves and multiple locks.

The present invention is directed to an improved mandrel and improved flow control valves in which vertically connected multiple flow control valves are placed in the sidepocket of a mandrel thereby increasing the capacity of the mandrel but allowing a single down well trip to be made to install or remove the multiple valves and in addition requiring only a single lock for the latching multiple valves in the sidepocket.

SUMMARY

One of the features of the present invention is the provision of a mandrel for use in a well tubing having a sidepocket, orientation means, a deflector guide, and a locking shoulder aligned with the pocket in which the pocket is of a vertical length sufficient for receiving a plurality of vertically connected flow control valves, each of which includes an inlet and an outlet whereby the plurality of valves can be jointly installed, removed, or locked in the pocket by the locking shoulder. The pocket includes a plurality of vertically spaced openings extending between the interior of the pocket and the outside of the body, one of the openings being positioned adjacent each of the inlets of the valves when the valves are installed. The pocket also includes a plurality of passageways extending from the interior of the pocket to the interior of the body and each of the passageways being positioned to communicate with one of the outlets of said valves when the valves are installed.

In one embodiment each of the passageways is positioned below one of the openings and the pocket includes a sealing surface on each side of each vertically spaced opening for coacting with a seal on the valves for isolating the valves from each other.

In another embodiment the number of openings in the pocket is two and the pocket includes a sealing surface above and below said two openings for coacting with seals on the valves and the number of passageways is two and one is positioned above the upper sealing surface and the other is positioned below the lower sealing surface.

A still further object of the present invention is the combination of a sidepocket mandrel and multiple flow control valves for use in a well tubing in which a plurality of vertically connected flow control valves each having an inlet and an outlet are positioned in the pocket and secured thereby by a single latch connected to the valve which engages a locking shoulder aligned with the pocket.

Yet a further object of the present invention is the provision of a gas lift valve assembly for positioning in the sidepocket of a mandrel having a locking shoulder in which the assembly comprises two gas lift valves, each having an inlet and an outlet, and a pressure charged bellows connected to a valve element, in which the valves are axially aligned and connected together and provided with a single lock for locking with the shoulder for holding the aligned valves in the pocket. The assembly may include a single gas charged chamber connected to each of the bellows. In one embodiment, the outlet of each valve is positioned below the inlet of each valve and a seal is positioned about each valve on both sides of each inlet. In another embodiment, the inlets of each valve are positioned adjacent each other with the outlet of the upper valve directed upwardly and the outlet of the lower valve directed downwardly and a seal is positioned around each valve above and below the two inlets.

Other and further objects, features and advantages will be apparent from the following description of presently preferred embodiments of the invention, given for the purpose of disclosure and taken in conjunction with the accompanying drawings.

DESCRIPTION OF THE PREFERRED EMBODIMENTS

While the present invention will be described in connection with the use of multiple gas lift valves, for purposes of illustration only, the multiple valves may be of other types such as injection valves or kill valves.

Figure 1:
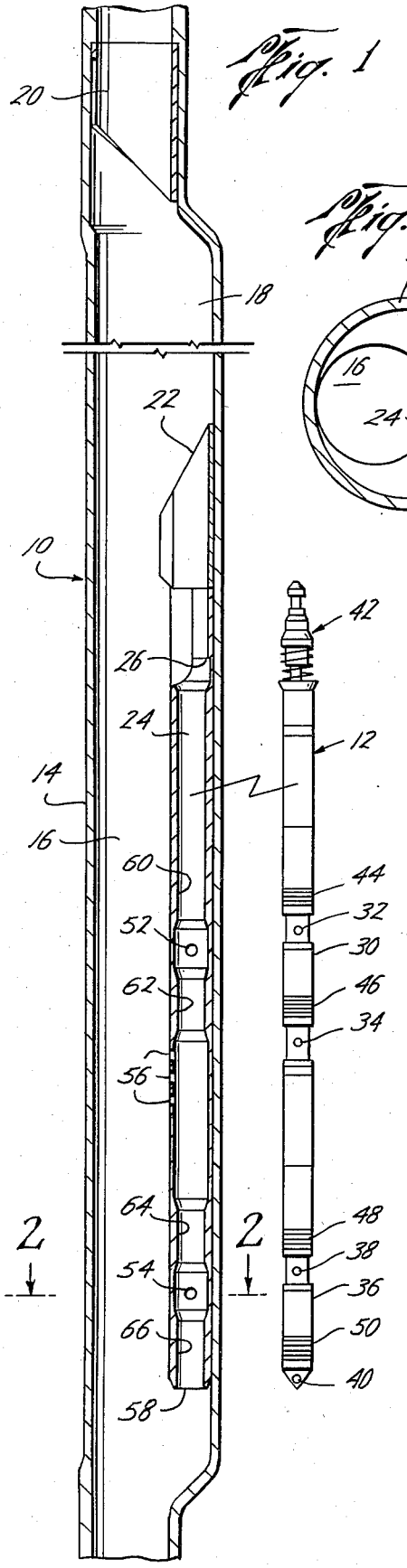
FIG. 1 is an elevational view, partly fragmentary and partly in cross section, illustrating one embodiment of the mandrel of the present invention and a multiple vertically connected valve assembly adapted to be placed in the sidepocket of the mandrel.
Figure 2:
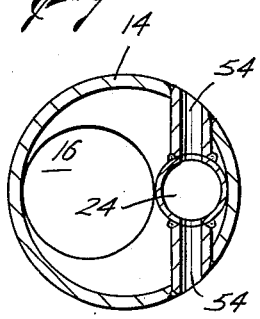
FIG. 2 is a cross-sectional view taken along the line 2—2 of FIG. 1, FIGS. 3A, 3B and 3C, are continuations of each other and are enlarged fragmentary views, partly in cross section, of the multiple valve assembly of FIG. 1.

Referring now to the drawings, particularly to FIGS. 1 and 2, the reference numeral 10 generally indicates the improved mandrel of the present invention and the reference numeral 12 generally indicates the improved multiple flow control valve assembly of the present invention.

The mandrel 10 generally includes a body 14, having an open bore 16 extending therethrough for alignment with a well tubing into which the mandrel is inserted by threaded connections (not shown) and an offset bore 18. The mandrel 10 also includes an orienting sleeve 20 in the main bore 16, a discriminating deflector guide 22, a sidepocket 24 and a locking lug or shoulder 26. As described in U.S. Pat. No. 3,741,299, the orienting sleeve 20 is used to orient a kickover tool into alignment with the sidepocket 24 for removing or installing a valve therein or therefrom, and the deflector 22 guides a valve, but prevents other well tools from catching in the pocket or on an installed valve.

The mandrel 10 is generally installed in an outer casing (not shown) which limits the size of the body 14 as well as the size of the pocket 24 and a valve therein. However, it is desirable to obtain greater valve areas, such as in gas lift operations, to obtain a greater flow of lifting gas. The present invention is directed to providing a multiple flow control valve assembly 12, an improved mandrel 10, and the combination thereof. Generally, the valve assembly 12 consists of a plurality of flow control valves, such as gas lift valves, which are axially aligned and connected together for insertion and removal from the sidepocket 24, and the sidepocket 24 is designed to coact with the valve assembly 12 which has the advantages of (1) increasing the valve control area thereby increasing the volume of gas controlled by the valve assembly 12, (2) allowing a single down well trip to be made to install or remove the plurality of valves in the assembly 12, and (3) requiring only a single lock for latching the multiplicity of valves in the sidepocket.

The valve assembly 12 includes a first valve 30 having an inlet 32 and an outlet 34, and a second valve 36 having an inlet 38 and an outlet 40. The valves 30 and 36 are axially aligned and vertically connected together whereby they can be jointly installed, removed, or locked in the pocket 24 by means of a conventional lock generally indicated by the reference numeral 24 such as the Camco Type BK-2 which coacts with the locking shoulder 26 to releasably latch the valve assembly 12 in the sidepocket 24. The valve assembly 12 also includes packing seals 44 and 46 which are above and below the inlets 32 of valve 30, respectively, and packing seals 48 and 50 which are above and below the inlets 38 of valve 36, respectively, thereby isolating the valves 30 and 36 from each other.

The sidepocket 24 is of a vertical length sufficient for receiving the plurality of vertically connected flow control valves 30 and 36. The valve pocket 24 also includes a plurality of vertically spaced openings 52 and 54 extending between the inside of the pocket 24 and the outside of the body 14 of the mandrel 10. The openings 52 are positioned to be adjacent the inlet openings 32 of the valve 30, and the openings 54 are positioned to be adjacent the inlets 38 of the valve 36 when the assembly 12 is installed in the sidepocket 24. A plurality of passageways such as passageways 56 and 58 extend between the interior of the pocket 24 and the interior of the body 14 of the mandrel 10 with passageway 56 being in position to communicate with the outlets 34 of valve 30 and passageway 58 being in position to communicate with the outlet 40 of valve 36. The interior of the valve pocket 24 also includes polished sealing surfaces 60, 62, 64 and 66 for coacting with the seals 44, 46, 48, and 50, respectively.

Figure 3A:
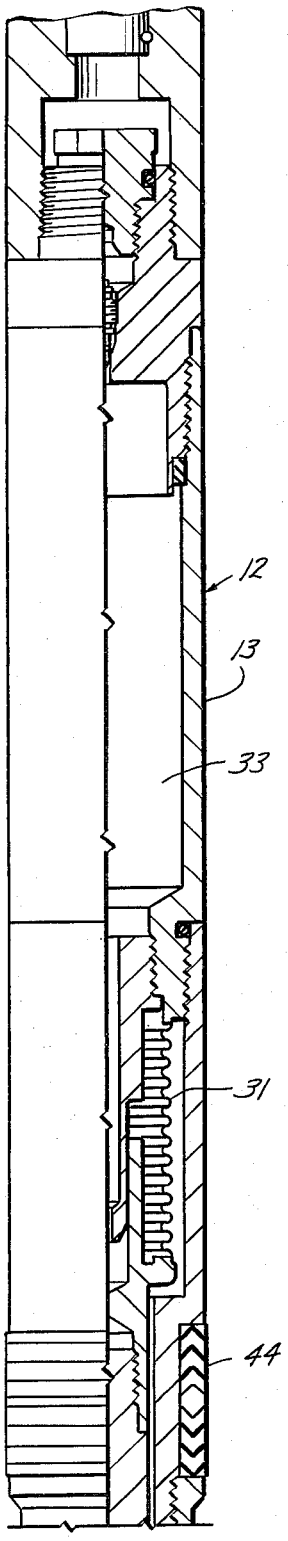
Figure 3B:
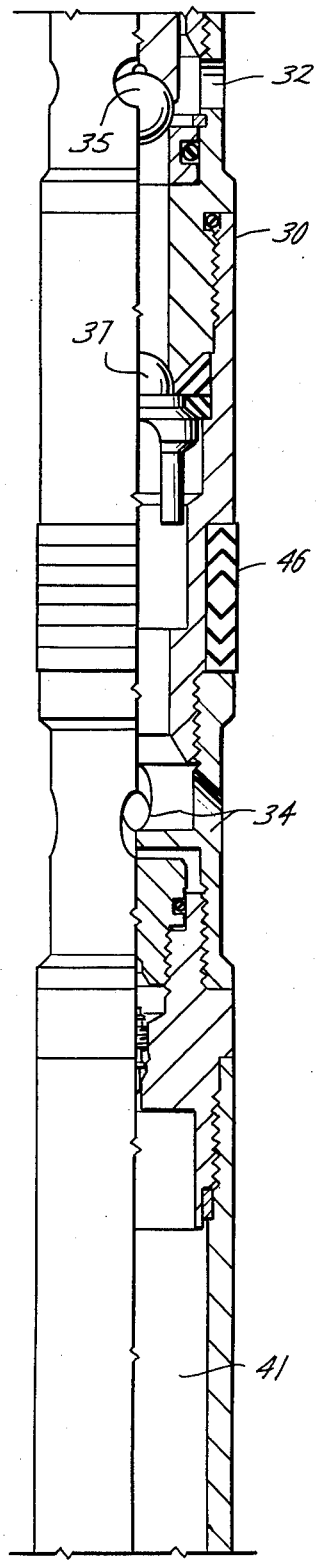
Figure 3C:
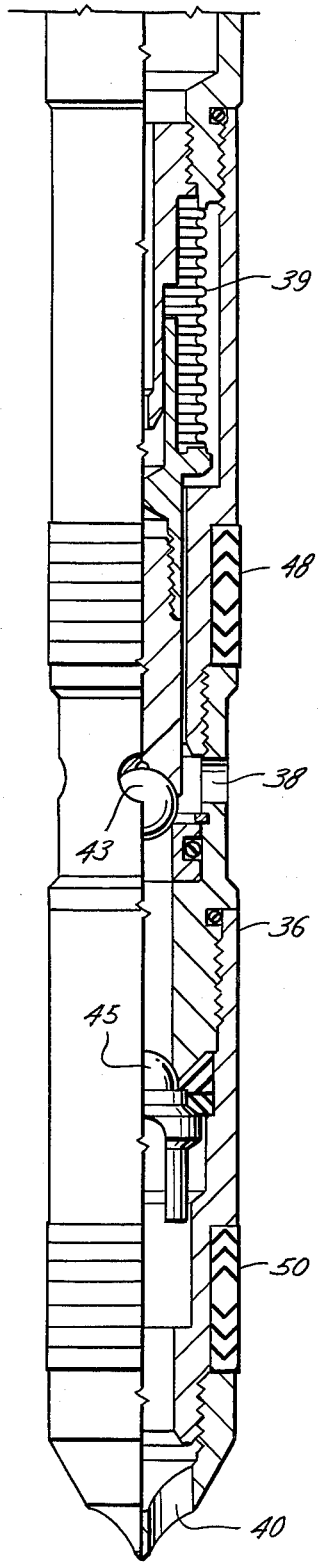
Figure 4:
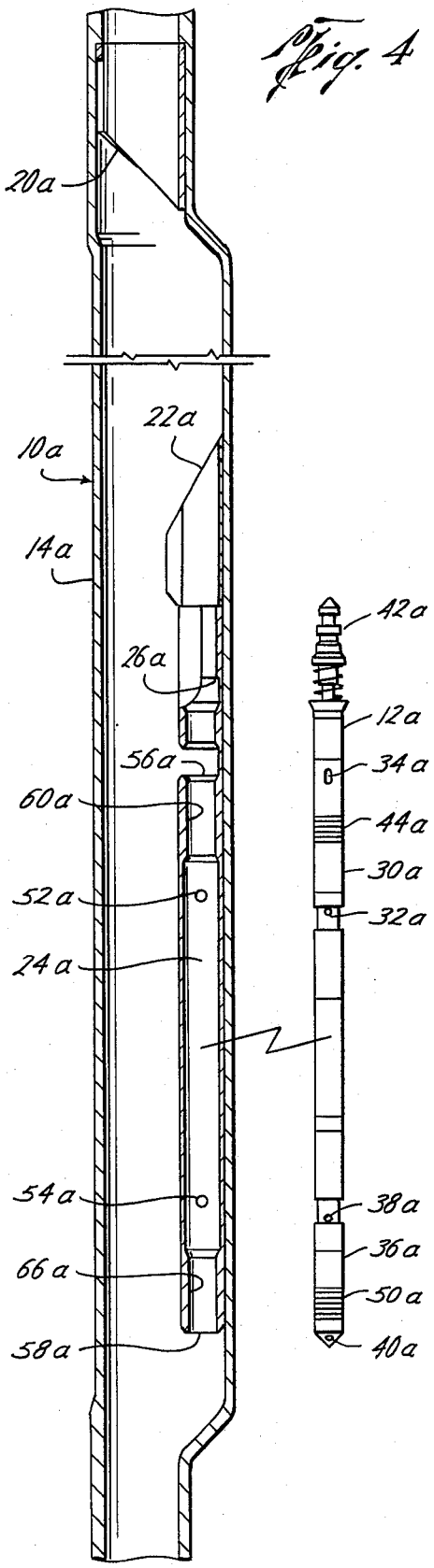
FIG. 4 is an elevational view, partly fragmentary, and partly in cross section, illustrating another embodiment of the mandrel of the present invention and a multiple valve assembly for positioning in the sidepocket of the mandrel.
Figure 5A:
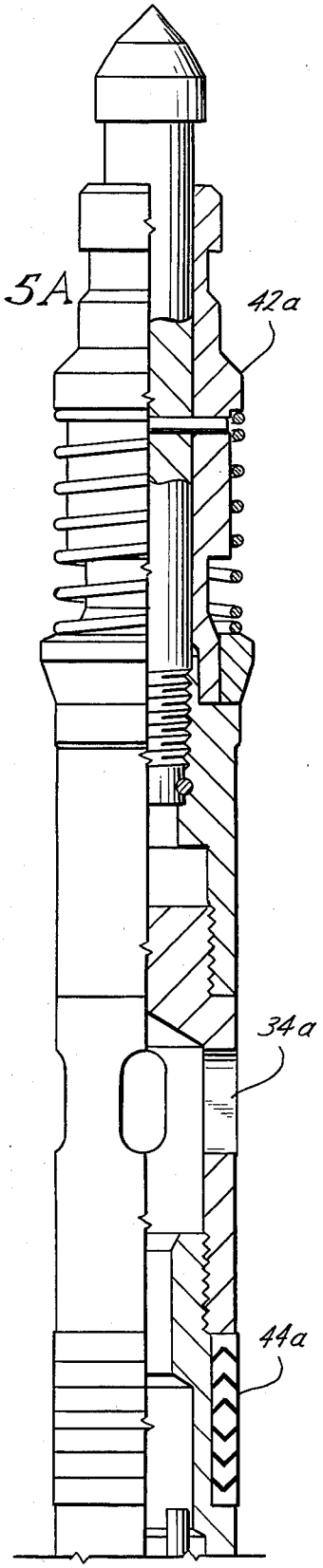
FIGS. 5A, 5B and 5C are continuations of each other of an enlarged elevational view, partly in cross section, of the valve assembly shown in FIG. 4, FIGS. 6A, 6B, 6C and 6D are continuations of each other of an enlarged elevational view, partly in cross section, of a further embodiment of a multiple valve assembly for use in the mandrel shown in FIG. 4.
Figure 5B:
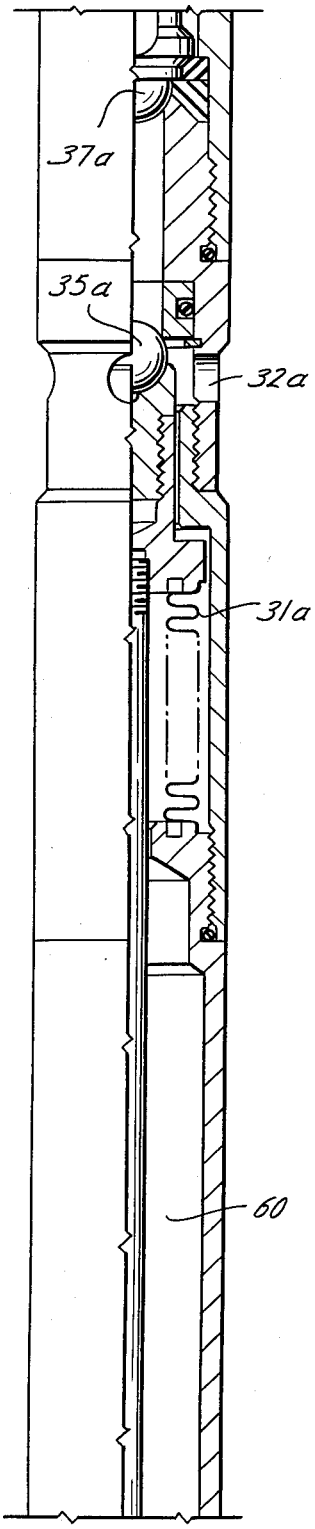
Figure 5C:
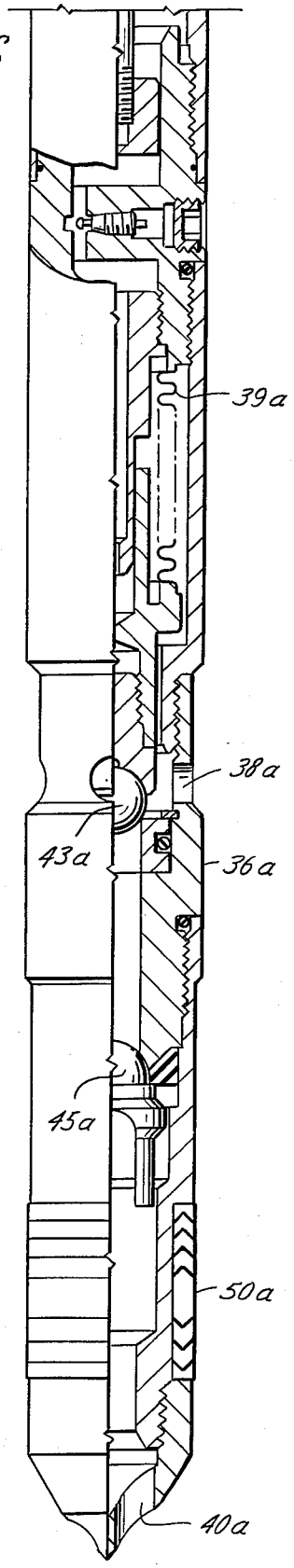
Figure 6A:
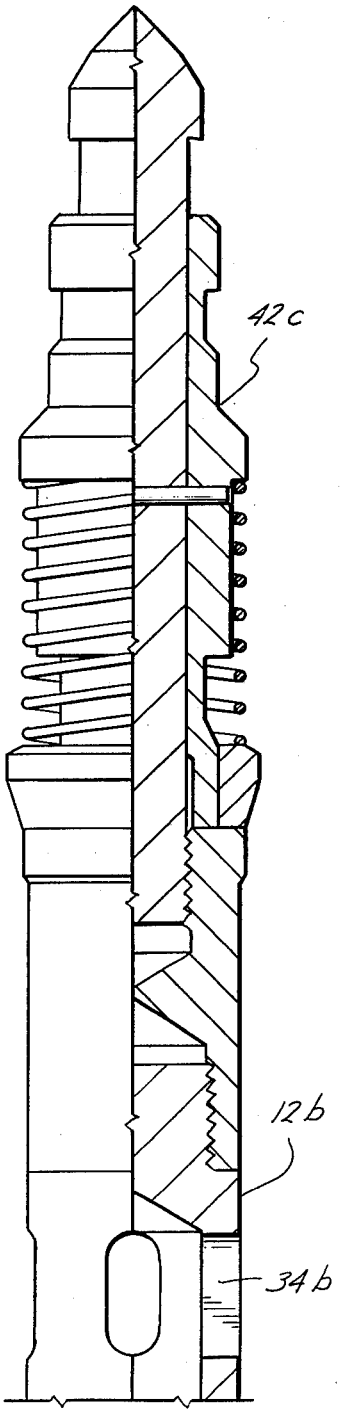
Figure 6B:
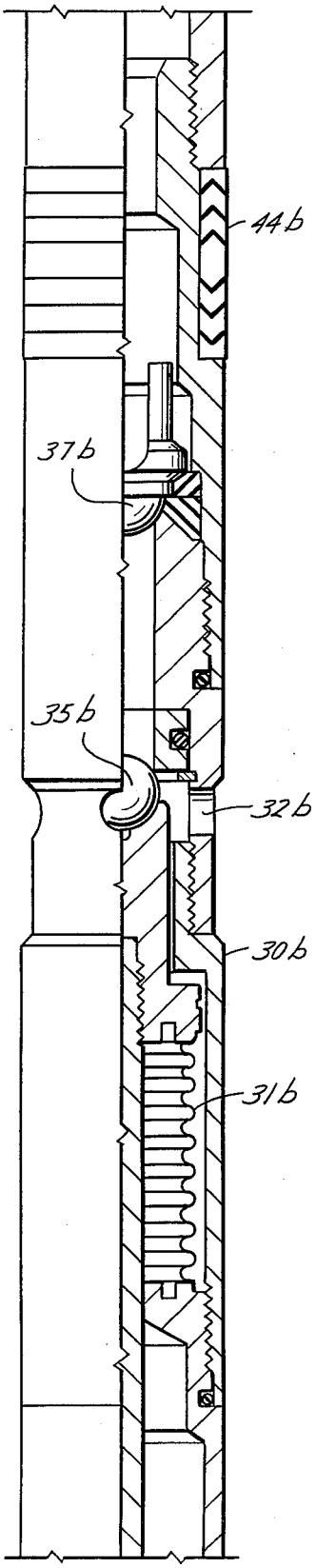
Figure 6C:
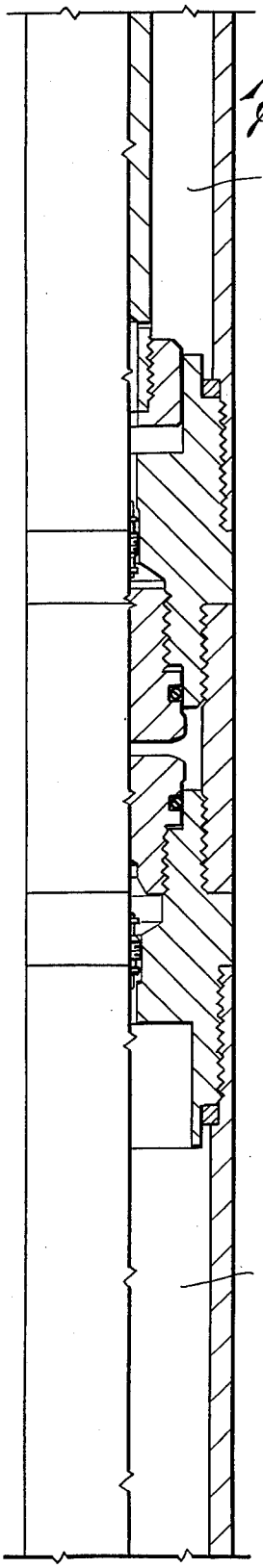
Figure 6D:
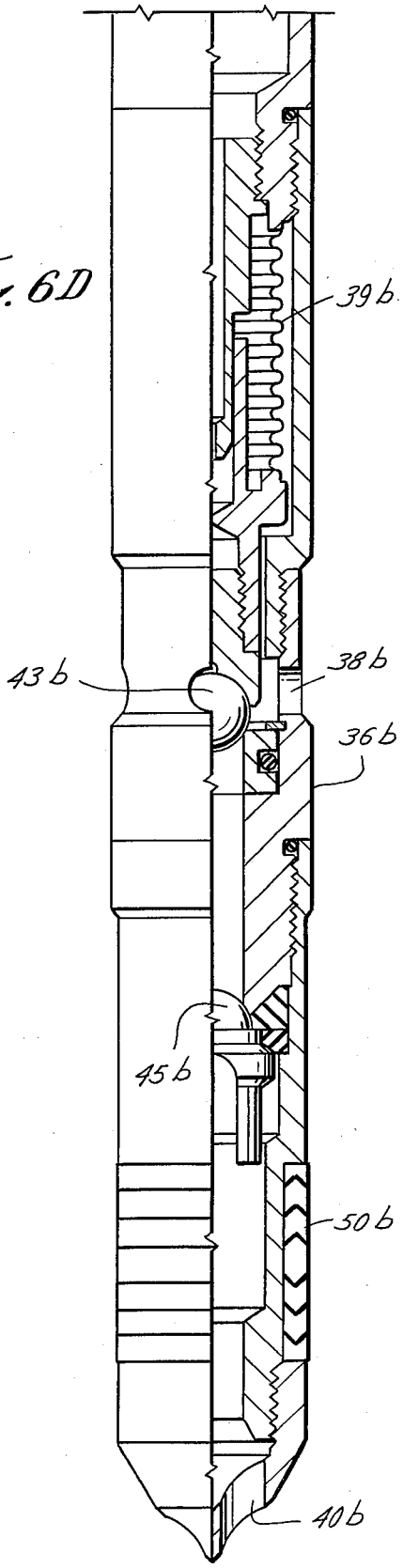

Referring now to FIGS. 3A, 3B and 3C, an enlarged view of the valve assembly 12 of FIG. 1 is best seen. Preferably, the gas lift valves 30 and 36 are of the pressure charged bellows type. In valve 30 a bellows 31 is actuated by pressure in a pressure charged chamber 33 to move a valve element 35 into a closed position. When sufficient gas pressure is applied to the inlets 32 overcoming the pressure charged bellows 31, the valve element 35 moves to the open position allowing the flow of gas through the inlet 32 through a check valve 37 and out the outlets 34. Similarly, valve 36 includes a pressure charged bellows 39 actuated by pressure in a chamber 41 acting in a direction to move a valve element 43 into a closed position as best seen in FIG. 3C. When sufficient gas is applied through the inlets 38 and against the bellows 39, the valve element 43 is moved to the open position and gas flows from the inlet 38 through the check valve 45 and out the outlets 40.

The mandrel 10 and valve assembly 42, as best described above, is the preferred embodiment as the valve inlets and outlets are positioned below the bellows whereby the bellows is not subjected to settling debris, each valve 30 and 36 has its own pressure charged chamber 33 and 41, respectively, so that the valves may be individually adjusted, and the valves are isolated from each other by the seals 44, 46, 48 and 50. However, the embodiment shown in FIG. 1 requires that the valve assembly 12 and pocket 24 be of a considerable length and the use of the four sealing surfaces 44, 46, 48 and 50 increases the cost and increases the forces required to set and remove the valve assembly 12.

Of course, various modifications of the present invention may be made such as that shown in FIG. 4 and FIGS. 5A, 5B and 5C where like parts to those shown in FIGS. 1-3 are fixed with the suffix "a". Again, valve assembly **12*a* includes two vertically connected flow control valves 30*a* and 36*a*, such as gas lift valves, which include a lock 42*a* for coacting with the locking shoulder 26*a* for holding the valve assembly 12*a* in the sidepocket 24*a* of mandrel 10*a*. The valve 30*a* has its outlet 34*a* above its inlet 32*a* and the valve 36*a* has its inlet 40*a* below its inlet 38*a* whereby the valves 30*a* and 36*a* are connected in a back-to-back relationship. This allows the use of a single charging chamber 60 for pressure charging both the bellows 31*a* of valve 32*a* and the bellows 39*a* of valve 36*a* thereby allowing the valve assembly 12*a* to be considerably shortened. In addition, with the back-to-back relationship of the valves 30*a* and 36*a*, the inlets 32*a* and 38*a* are adjacent to each other and only two packing seals 44*a* and 50*a* need be used, one of which is positioned above the inlet 32*a* and one of which is positioned below the inlet 38*a* thereby reducing the force necessary to install or remove the valve assembly 12*a*. However, valve assembly 12*a* has the disadvantages that the valve 30*a* being upside down with its inlet 32*a* and its outlet 34*a* thereabove thereby subjecting bellows 31*a* to settling debris. In addition, the valve assembly 12*a* by having a single charging chamber 60 makes it slightly more difficult to adjust the individual valves 30*a* and 36*a*** for a predetermined opening pressure point.

The mandrel **10*a* is configured to coact with the valve assembly 12*a*. Thus the sidepocket 24*a* is of a vertical length sufficient for receiving the valve assembly 12*a* whereby the plurality of valves may be jointly installed, removed, or locked in the pocket 24*a* by the locking shoulder 26*a* coacting with the valve latch 42*a*. In addition, the plurality of vertically spaced openings 52*a* and 54*a* extend between the interior of the pocket and the outside of the mandrel body 14*a* with the openings 52*a* being adjacent the inlets 32*a* of the valve 30*a* and the openings 54*a* being adjacent the inlets 38*a* of the valve 36*a* when the assembly 12*a* is installed in the sidepocket 24*a*. Also, the sidepocket 24*a* includes passageway 56*a* extending between the interior of the pocket 24*a* and the interior of the mandrel body 14 and is positioned to communicate with the outlets 34*a* of the valve 30*a* while the passageway 58*a* communicates between the outlets 40***a* of the valve 36*a*. Polished sealing surfaces 60*a* and 66*a* are positioned to coact with the seals 44*a* and 50*a*.

Referring to FIGS. 6A, 6B, 6C and 6D, a further modification of a gas lift valve assembly 12*b* is best seen. In the embodiment shown, the valves 30*b* and 36*b* are axially aligned and connected back to back with the inlets 32*b* and 38*b* adjacent to each other. The valve assembly 12*b* shown in FIGS. 6A–6D is similar in construction and operation to the valve 12*a* with the exception that separate pressure chambers 33*b* and 41*b* are provided for each of the valves 30*a* and 36*a* which allows the valve to be separately adjusted to a predetermined opening pressure. In addition, the embodiment shown in FIGS. 6A–6D has only two seals, 44*b* and 50*b*, thereby allowing valve 12*b* to be more easily inserted and removed from a sidepocket. However, the valve 12*b* is still subject to the disadvantage in that the pressure charged bellows 31*b* of the upper valve 30*b* is subject to contamination by debris passing through the valve 30*b*. The valve 12*b* is adapted to be positioned in a mandrel similar to mandrel 10*a* shown in FIG. 4 with the exception that the sidepocket 24*a* would need to be extended to accommodate the greater vertical length of the valve assembly 12*b* as compared to the valve assembly 12*a*.

The present invention, therefore, is well adapted to carry out the objects and attain the ends and advantages mentioned as well as others inherent therein. While presently preferred embodiments of the invention are given for the purpose of disclosure, numerous changes in the details of construction and arrangement of parts, may be made which will readily suggest themsleves to those skilled in the art and which are encompassed by the spirit of the invention and the scope of the appended claims.

What is claimed is:

1. The combination of a mandrel and multiple flow control valves for use in a well tubing comprising, a mandrel having a body with an open bore extending therethrough for alignment with the well tubing and having an offset bore adjacent the open bore, orientation means in the open bore, a pocket positioned inside the body in the offset bore, a deflector guide positioned in the offset bore above the pocket, a locking shoulder secured in the body and aligned with the pocket, a plurality of vertically connected but independently actuated gas lift valves each having an inlet and an outlet for positioning in the pocket, each said valve having a pressure charged bellows positioned above and acting downwardly against a valve element in a direction to close said valve, a single latch connected to the valves for engagement with the locking shoulder for locking the valves in the pocket, said pocket being of a vertical length sufficient for receiving the valves, a plurality of vertically spaced openings extending between the interior of the pocket and the outside of the body, one of said openings being positioned adjacent each of the inlets of said valves when the valves are installed, and a plurality of passageways extending between the interior of the pocket and the interior of the body, one of the passageways being positioned to communicate with each of the outlets of said valves when the valves are installed.

* * * * *